US010837267B2

(12) United States Patent
Xiao et al.

(10) Patent No.: US 10,837,267 B2
(45) Date of Patent: Nov. 17, 2020

(54) WELL KICKOFF SYSTEMS AND METHODS

(71) Applicant: Saudi Arabian Oil Company, Dhahran (SA)

(72) Inventors: Jinjiang Xiao, Dhahran (SA); Rafael Adolfo Lastra, Dhahran (SA); Brian A. Roth, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 69 days.

(21) Appl. No.: 15/812,256

(22) Filed: Nov. 14, 2017

(65) Prior Publication Data

US 2018/0149003 A1 May 31, 2018

Related U.S. Application Data

(60) Provisional application No. 62/427,234, filed on Nov. 29, 2016.

(51) Int. Cl.

| | |
|---|---|
| ***E21B 43/12*** | (2006.01) |
| ***F04B 47/02*** | (2006.01) |
| ***F04B 53/12*** | (2006.01) |
| ***E21B 34/08*** | (2006.01) |
| *E21B 17/10* | (2006.01) |
| *E21B 17/20* | (2006.01) |

(52) U.S. Cl.

CPC ..... *E21B 43/126* (2013.01); *E21B 34/08* (2013.01); *E21B 43/121* (2013.01); *F04B 47/02* (2013.01); *F04B 47/026* (2013.01); *F04B 53/126* (2013.01); *E21B 17/1078* (2013.01); *E21B 17/20* (2013.01); *E21B 2200/04* (2020.05)

(58) Field of Classification Search

CPC ..... E21B 43/121; E21B 43/126; E21B 34/08; F04B 47/02; F04B 47/026; F04B 53/126

See application file for complete search history.

(56) References Cited

U.S. PATENT DOCUMENTS

| | | | |
|---|---|---|---|
| 1,559,579 | A | 11/1925 | Mowers |
| 5,636,687 | A | 6/1997 | Brown |
| 6,186,238 | B1 | 2/2001 | Tornquist |
| 6,220,358 | B1 | 4/2001 | Leniek, Sr. |
| 6,273,690 | B1 | 8/2001 | Fischer, Jr. et al. |
| 6,725,916 | B2 | 4/2004 | Gray et al. |
| 7,954,545 | B2 | 6/2011 | Hearn et al. |
| 8,347,955 | B1 | 1/2013 | Sewell et al. |
| 8,627,892 | B2 | 1/2014 | Nadkrynechny |
| 8,851,860 | B1 | 10/2014 | Mail |

(Continued)

OTHER PUBLICATIONS

International Search Report and Written Opinion for International Application No. PCT/US2017/063622; report dated Feb. 15, 2018; 18 pages.

*Primary Examiner* — Nicole Coy

(74) *Attorney, Agent, or Firm* — Bracewell LLP; Constance G. Rhebergen; Linda L. Morgan

(57) ABSTRACT

Systems and methods for removing fluid from a subterranean well with a fluid removal system includes lowering an elongated member into tubing of the subterranean well to a lower position, the elongated tubing having a plunger or valve body located at an end, wherein fluid passes past the plunger or through a valve opening as the valve body moves into the subterranean well. The plunger or valve body is moved in a direction out of the subterranean well so that fluid cannot pass the plunger or through the valve opening, moving the fluid out of the subterranean well.

22 Claims, 5 Drawing Sheets

(56) References Cited

U.S. PATENT DOCUMENTS

| | | | |
|---|---|---|---|
| 2008/0283236 | A1 | 11/2008 | Akers et al. |
| 2010/0326670 | A1 | 12/2010 | Griffiths et al. |
| 2014/0178210 | A1 | 6/2014 | Bradford, Jr. |
| 2016/0097265 | A1 | 4/2016 | Bishop |
| 2017/0058651 | A1 | 3/2017 | Damiano et al. |
| 2017/0096884 | A1 | 4/2017 | Michel |

WELL KICKOFF SYSTEMS AND METHODS

CROSS REFERENCE TO RELATED APPLICATION

This application claims priority to and the benefit of U.S. Provisional Application Ser. No. 62/427,234, filed Nov. 29, 2016, titled "Well Kickoff Systems And Methods," the full disclosure of which is incorporated herein by reference in its entirety for all purposes.

BACKGROUND OF THE DISCLOSURE

1. Field of the Disclosure

This disclosure relates generally to well kickoff operations and in particular, to the removal of heavy fluids from subterranean hydrocarbon wells during well kickoff operations.

2. Description of the Related Art

Drilling and completion of a hydrocarbon development well is typically performed by an overbalance with heavy fluids, such as mud, for well control purpose. The density of the heavy fluids is adjusted with the use of weighting agents such as barite, barium sulphate, and others so that the hydrostatic pressure due to the fluid column is higher than the formation pressure. With the well killed or dead, no hydrocarbon will be produced to surface, insuring safe operations. After completion or workover, some wells, due to low reservoir pressure, cannot start to produce without some form of artificial lift initially. Therefore, with the well killed or dead, production cannot start without unloading these fluids in an operation referred to as well kickoff.

In other situations, wells can produce high water cut or rich condensate and when a shutdown occurs, purposely or not, liquids can accumulate and settle in the wellbore. This shutdown could be for facility maintenance or other reasons. Water and condensate can settle in the wellbore, resulting in high hydrostatic head preventing well restart naturally. This liquid loading may prevent well restart without a kickoff operation.

In some current systems, well kickoff or initiation is conducted with nitrogen injection using coil tubing, known as nitrogen kickoff. One common practice to liven a well is to use N2 injection with coil tubing, known as N2 kickoff in the industry. Coil tubing is inserted into the well production tubing through the top of the Christmas tree with all control valves open. Well control equipment known as a coil tubing blowout preventer is used in the operation to insure safe operation. N2 can be either generated on site or brought to the wellsite in tanks as liquid which is heated up to gas. As nitrogen is injected into the well, it forms gas bubbles in the tubing. These bubbles help to lift the heavy fluid in the tubing. This lifting action reduces the column weight of hydrostatic pressure in the wellbore. When the pressure in the wellbore is reduced below the reservoir pressure, the well begins to flow.

SUMMARY OF THE DISCLOSURE

Embodiments disclosed herein provide systems and methods to initiate well production efficiently and with reduced operational cost compared to current systems and methods. Certain systems and methods of this disclosure eliminate the need for coil tubing.

In an embodiment of this disclosure, a method for removing a fluid from a subterranean well includes lowering an elongated member into a tubing of the subterranean well a travel length of the tubing to a lower position, the elongated member having a plunger located at an end of the elongated member, wherein the fluid passes through a gap between the external surface of the plunger and the inner diameter surface of the tubing as the plunger moves in a direction into the subterranean well. The plunger is moved in a direction out of the subterranean well with the external surface of the plunger sealingly engaging the inner diameter surface of tubing, lifting fluids out of the subterranean well.

In alternate embodiments, the elongated member can be a rod, coiled tubing, wireline, and slickline. The plunger can be a valve body and fluid can pass through a valve opening of a one way valve and into the valve body as the valve body moves in a direction into the subterranean well. Moving the valve body in a direction out of the subterranean can include moving the one way valve to a closed position so that the fluid cannot pass through the valve opening.

In an embodiment of this disclosure a method for removing a fluid from a subterranean well includes lowering an elongated member into a tubing of the subterranean well a travel length of the tubing to a lower position, the elongated member having a valve body located at an end of the elongated member, wherein the fluid passes through a valve opening of a one way valve and into the valve body as the valve body moves in a direction into the subterranean well. The valve body is moved in a direction out of the subterranean well so that the one way valve moves to a closed position and the fluid cannot pass through the valve opening, moving the fluid in the direction out of the subterranean well. The tubing is free of tubing inner diameter restrictive devices along the travel length that would restrict movement of the elongated member so that the elongated member moves freely between an upper position proximate to a top end of the tubing and the lower position In alternate embodiments, lowering the elongated member into the tubing of the subterranean well can include unrolling the elongated member from a reel, and moving the valve body in the direction out of the subterranean well can include rerolling the elongated member onto the reel. The elongated member can be a coiled tubing, a rod, a wireline, or a slickline.

In other alternate embodiments, the valve body can sealingly engage an inner diameter surface of the tubing as the elongated member moves out of the subterranean well. The valve body can alternately sealingly engage an inner diameter surface of the tubing as the elongated member moves into the subterranean well and as the elongated member moves out of the subterranean well. The valve body can be fixed to the end of the elongated member. A rod can extending within the elongated member and moving the valve body in the direction out of the subterranean well can include moving the rod in the direction out of the subterranean well.

In an alternate embodiment of this disclosure, a method for removing a fluid from a subterranean well includes lowering an elongated member into a tubing of the subterranean well a travel length of the tubing to a lower position, the elongated member having a valve body located at, and fixed to, an end of the elongated member, wherein the fluid passes through a valve opening of a one way valve and into the valve body as the elongated member moves in a direction into the subterranean well. The elongated member is moved in a direction out of the subterranean well so that the one way valve moves to a closed position and the fluid cannot pass through the valve opening, moving the fluid in the direction out of the subterranean well, wherein the elongated member is moved in the direction out of the subterranean well the entire travel length.

In alternate embodiments, an outer diameter of the valve body can sealing engage an inner diameter of the tubing when moving the elongated member in the direction out of the subterranean well. An outer diameter of the valve body can alternately sealingly engage an inner diameter of the tubing when lowering the elongated member into the tubing of the subterranean well and when moving the elongated member in the direction out of the subterranean well. The valve body can be in fluid communication with an annulus between an outer diameter of the elongated member and the inner diameter of the tubing so that moving the elongated member in the direction out of the subterranean well can move the fluid in the annulus in the direction out of the subterranean well. The elongated member can be coiled tubing and moving the elongated member in the direction out of the subterranean well can move the fluid in the coiled tubing in the direction out of the subterranean well. A standing valve can be located within the tubing axially below the travel length of the tubing, wherein the standing valve can prevent the fluid from exiting the bottom end of the tubing when lowering the elongated member into the tubing of the subterranean well.

In yet another alternate embodiment of this disclosure, a method for removing a fluid from a subterranean well includes setting a standing valve within a tubing axially below a travel length of the tubing. A hollow elongated member is lowered into the tubing of the subterranean well the travel length of the tubing to a lower position, wherein the standing valve prevents the fluid from exiting the bottom end of the tubing when lowering the elongated member into the tubing of the subterranean well, and wherein an outer diameter of a valve body sealingly engages an inner diameter of the tubing while lowering the hollow elongated member into the tubing, moving the fluid in a direction out of the subterranean well through the elongated member. The elongated member is moved in a direction out of the subterranean well, wherein the outer diameter of the valve body sealingly engages the inner diameter of the tubing while moving the elongated member in the direction out of the subterranean well. The elongated member is moved in the direction out of the subterranean well the entire travel length.

In alternate embodiments, a circulating valve of the elongated member can be in a closed position while lowering the hollow elongated member into the tubing, and the circulating valve can be in an open position while moving the elongated member in the direction out of the subterranean well. The fluid can pass through a valve opening of a one way valve and into the valve body as the elongated member moves in a direction into the subterranean well, and the one way valve can move to a closed position and the fluid cannot pass through the valve opening while moving the elongated member in the direction out of the subterranean well.

In still another alternate embodiment of this disclosure, a method for removing a fluid from a subterranean well includes lowering a hollow elongated member into a tubing of the subterranean well a travel length of the tubing to a lower position, the elongated member having a barrel at an end of the elongated member, wherein a rod extends within the elongated member and the rod has a valve body located at an end of the rod and within the barrel. The rod is reciprocated between a direction out of the subterranean well and a direction into the subterranean well so that: moving the rod in the direction out of the subterranean well closes a lower one way valve and opens an upper one way valve and the fluid within the valve body moves out of the valve body and into the elongated member; and moving the rod in the direction into the subterranean well opens the lower one way valve and closes the upper one way valve and the fluid within the subterranean well moves into the valve body. The tubing is free of tubing inner diameter restrictive devices along the travel length so that the elongated member moves freely between an upper position proximate to a top end of the tubing and the lower position.

In alternate embodiments, the elongated member can be coiled tubing and a hydraulic linear pump at a surface located at an end of a coil tubing reel can reciprocate the rod between the direction out of the subterranean well and the direction into the subterranean well. The rod can be selected from a group consisting of individual rods, continuous coiled rods, or wire. The rod can be centralized within the elongated member to prevent the rod from engaging an inner diameter surface of the elongated member.

In other embodiments of the current application, a fluid removal system for a subterranean well includes an elongated member sized to extend into a tubing of the subterranean well a travel length of the tubing to a lower position. A valve body is located at an end of the elongated member. A one way valve is moveable between an open position where a fluid can pass through a valve opening and into the valve body as the valve body moves into the subterranean well, and a closed position where the fluid cannot pass through the valve opening as the valve body moves out of the subterranean well. The tubing is free of tubing inner diameter restrictive devices along the travel length so that the elongated member is freely moveable between an upper position proximate to a top end of the tubing and the lower position.

In alternate embodiments, a portion of the elongated member can remain coiled around a reel during a fluid removal operation. The elongated member can be a coiled tubing or a rod. The valve body can sealingly engage an inner diameter surface of the tubing as the elongated member moves out of the subterranean well. The valve body can sealingly engage an inner diameter surface of the tubing as the elongated member moves into the subterranean well, and as the elongated member moves out of the subterranean well. The valve body can be fixed to the end of the elongated member. A rod can extend within the elongated member and the valve body can be fixed to an end of the rod.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
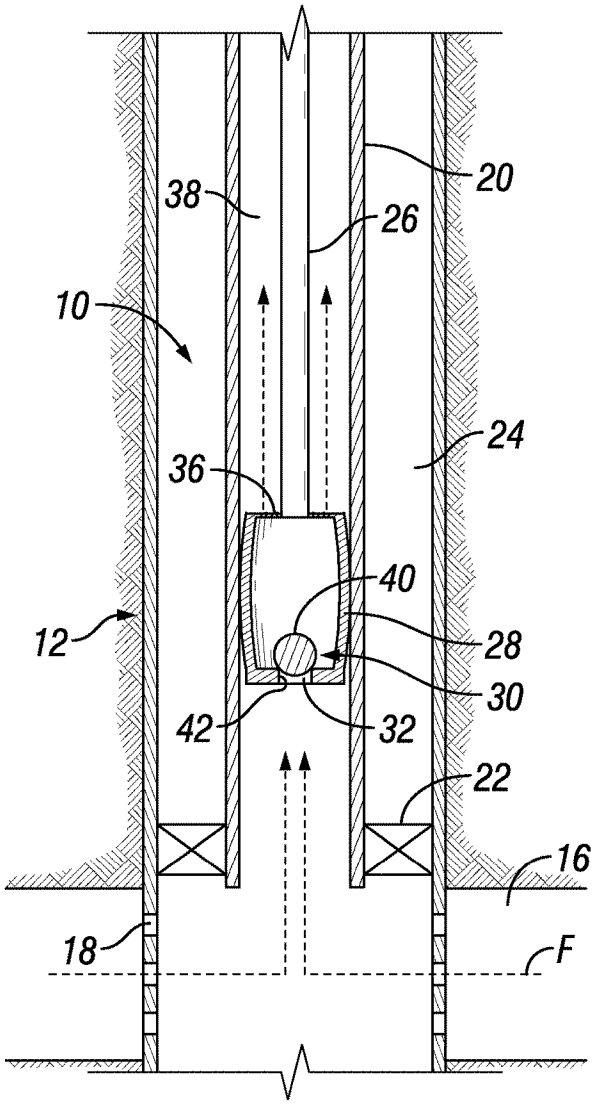
FIG. 1 is a section view of a fluid removal system in accordance with an embodiment of this disclosure.

Looking at FIG. 1, fluid removal system 10 for subterranean well 12 is shown. Subterranean well 12 extends from an earth's surface 14 (FIG. 7) to a subterranean location adjacent hydrocarbon reservoir 16. Subterranean well can extend through and past hydrocarbon reservoir 16 to a second or third or more reservoir. Although subterranean well 12 is shown as a generally vertical well, subterranean well 12 can alternately have non-vertical portions, such as slanted or horizontal portions. Perforations 18 through a side of subterranean well 12 and into hydrocarbon reservoir 16 can assist in the fluid communication between hydrocarbon reservoir 16 and subterranean well 12 so that produced fluids can flow out of hydrocarbon reservoir 16 and into subterranean well 12 as shown by arrows "F."

Figure 6:
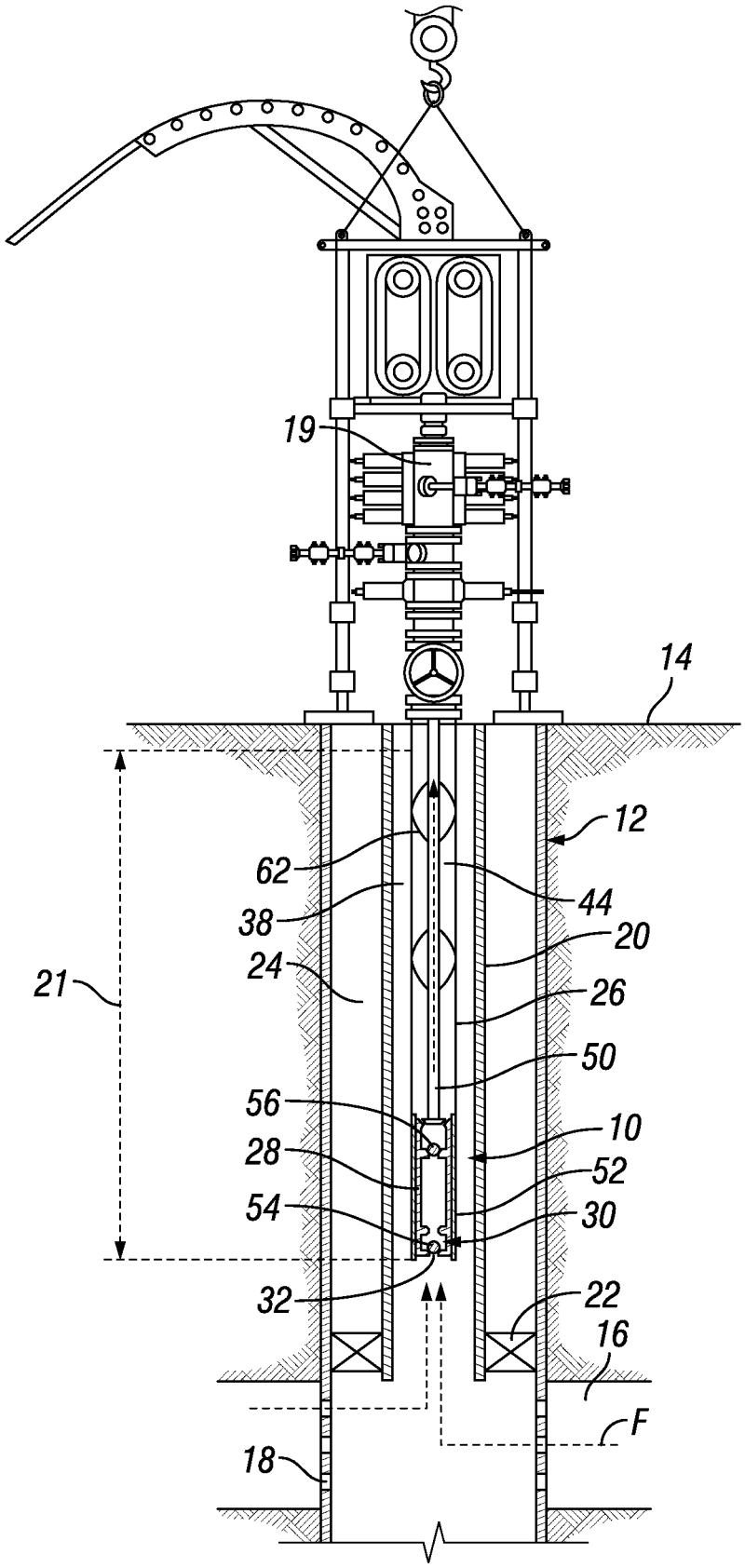
FIG. 6 is a section view of a fluid removal system in accordance with an embodiment of this disclosure.

Tubing 20 can extend within subterranean well 12. Tubing 20 can be a production tubing that extends from surface 14 to proximate hydrocarbon reservoir 16 in order to deliver produced fluids from hydrocarbon reservoir 16 to a surface system, such as a wellhead 19 (FIG. 6). A packer can circumscribe tubing 20 and seal outer annulus 24 defined between an outer diameter of tubing 20 and an inner diameter of subterranean well 12.

Fluid removal system 10 includes elongated member 26. Elongated member 26 is sized to extend into tubing 20 of subterranean well 12 a travel length 21 (FIG. 6) of tubing 20 to a lower position. In the example of FIG. 1, the lower position is shown to be proximate to the bottom end of tubing 20. In alternate embodiments, the lower position can be to any distance between the top of the tubing 20 and the bottom end of tubing 20. In certain embodiments, as more fully discussed herein, elongated member 26 can be a hollow elongated member such as coiled tubing, or can be a rod or wire. Elongated member 26 can be formed of a metallic or a composite material.

Valve body 28 is located at an end of elongated member 26. Valve body 28 is a generally tubular shaped member with an outer diameter sized to fit within the inner diameter of tubing 20. In certain embodiments, as more fully discussed herein, valve body 28 has a one way valve 30. One way valve 30 can be moveable between an open position where fluid can pass through valve opening 32 and into valve body 28 as valve body 28 moves into subterranean well 12, and a closed position where fluid cannot pass through valve opening 32 as valve body 28 moves out of subterranean well 12.

Figure 5:
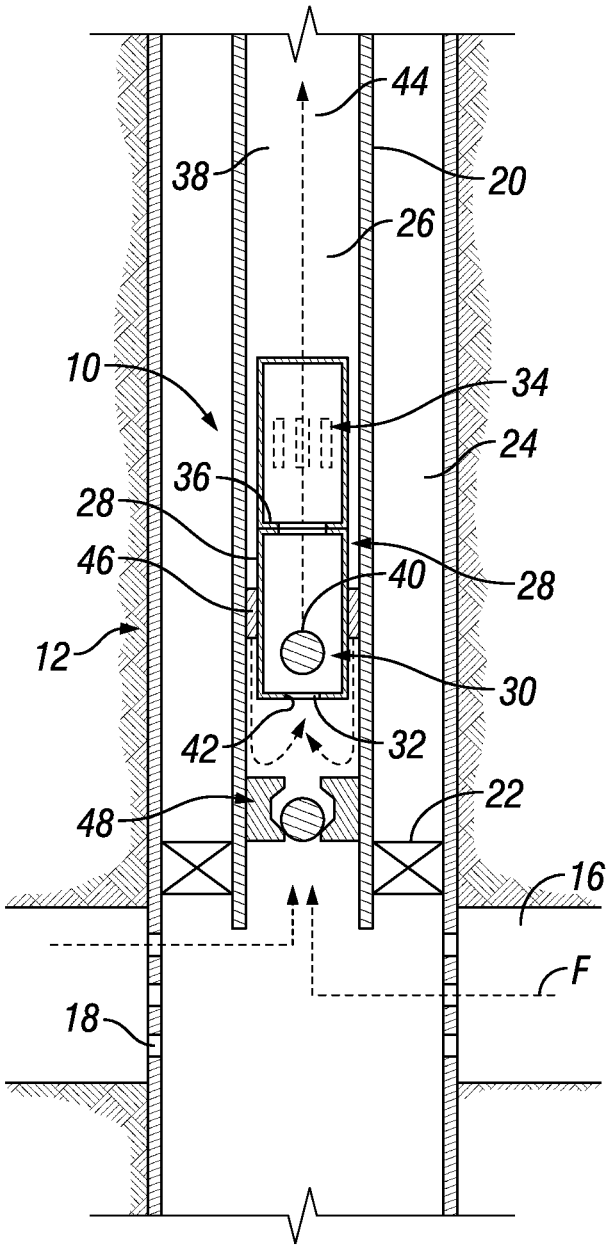
FIG. 5 is a section view of a fluid removal system in accordance with an embodiment of this disclosure.

In other alternate embodiments, valve body 28 has circulating valve 34 (FIG. 5). Circulating valve 34 can be in a closed position while lowering elongated member 26 into tubing 20 and circulating valve 34 can be in an open position while moving elongated member 26 in a direction out of subterranean well 12.

In each of the embodiments of this disclosure, tubing 20 is free of tubing inner diameter restrictive devices along the travel length 21 of tubing 20 that have an inner diameter opening that is smaller than the outer diameter of elongated member 26 so that elongated member 26 is freely moveable between an upper position proximate to a top end of tubing 20 and the lower position. For example, there can be no anchors, valves or other set equipment in tubing 20 along the travel length 21 of tubing 20 that would prevent elongated member 26 from moving along the travel length 21 of tubing 20 without first having to be retrieved. There may, however, be some slight restrictions in tubing 20 which would not interfere. For example, there may be nipple inner diameters, wellhead profiles for back pressure valves, or subsurface safety valves that still provide for sufficient inner diameter spaces within tubing 20 for elongated member 26 to freely move between the upper position and the lower position. Fluid removal system 10 is a temporary system used during kickoff only and having a system that is entirely freely moveable along the travel length 21 of tubing 20 provides a more efficient fluid removal method.

Looking more specifically at the embodiment of FIG. 1, valve body 28 is a generally cylindrical member fixed to an end of elongated member 26. In the embodiment of FIG. 1, elongated member 26 can be a solid member such as a rod, or a hollow member such as coiled tubing. When elongated member 26 is a rod, the rod can be made up of individual rods connected together, a continuous coiled rod, or a wireline, or slickline.

Valve body 28 has upper openings 36 that provide fluid communication between the interior of valve body 28 and an inner annulus 38 between an outer diameter of elongated member 26 and the inner diameter of tubing 20.

Figure 2B:
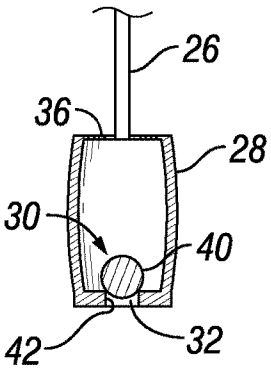
FIG. 2*b* is a section view of a valve body of the fluid removal system of claim 1, shown moving out of the subterranean well.
Figure 2A:
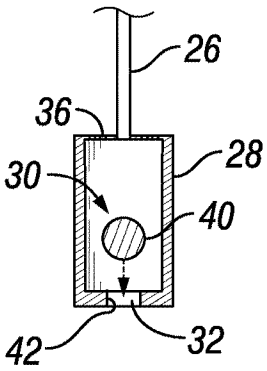
FIG. 2*a* is a section view of a valve body of the fluid removal system of claim 1, shown moving into the subterranean well.

Looking at FIG. 2*a*, one way valve 30 is shown as a ball check type valve with ball 40 and seat 42. In alternate embodiments, one way valve 30 can be other types of one way valves known in the art. When valve body 28 moves in a direction into subterranean well 12, one way valve 30 is in an open position and fluid passes through valve opening 32 of one way valve 30 and into valve body 28. Fluid can then pass through upper openings 36 and into inner annulus 38. As shown in FIG. 2*a*, when valve body 28 moves in a direction into subterranean well 12, the outer diameter of valve body 28 can be in a retracted position without sealing engagement with the inner diameter of tubing 20. Valve body 28 can move in a direction into tubing 20 by its own weight or can be pushed downward by elongated member 26.

Looking at FIGS. 1 and 2*b*, when moving valve body 28 in a direction out of subterranean well 12, one way valve 30 moves to a closed position and fluid cannot pass through valve opening 32. As shown in FIGS. 1 and 2*b*, an outer diameter of valve body 28 can be in an expanded position and sealingly engage the inner diameter surface of tubing 20 as elongated member 26 and valve body 28 move in a direction out of subterranean well 12. Therefore, when moving valve body 28 in a direction out of subterranean well 12, fluid within valve body 28 and axially above valve body 28 within inner annulus 38 moves in a direction out of subterranean well 12 and can be produced to the surface.

Valve body 28 can be a plunger that allows fluid to circulate past valve body 28 only the upward direction, using either especially designed seals or one or more one way valves. Valve body 28 can move to an expanded position due to the weight of fluids trapped within valve body 28 as valve body 28 moves in a direction out of subterranean well 12. Alternately, an actuation system known in the art can be used to move valve body 28 to an expanded position. In other alternate embodiments, separate seals or one way valves located circumferentially around valve body 28 can sealingly engage the inner diameter surface of tubing 20 to form an annular seal between the outer diameter of valve body 28 and the inner diameter surface of tubing 20.

Figure 3B:
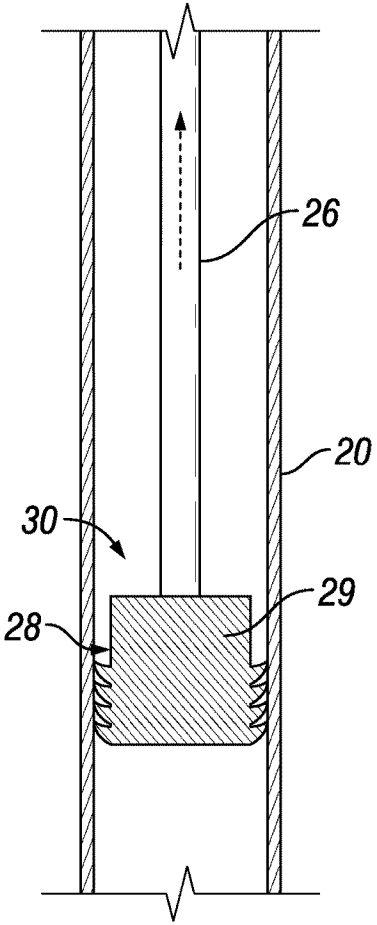
FIG. 3*b* is a section view of a valve body of a fluid removal system, shown as a plunger moving out of the subterranean well in accordance with an embodiment of this disclosure.
Figure 3A:
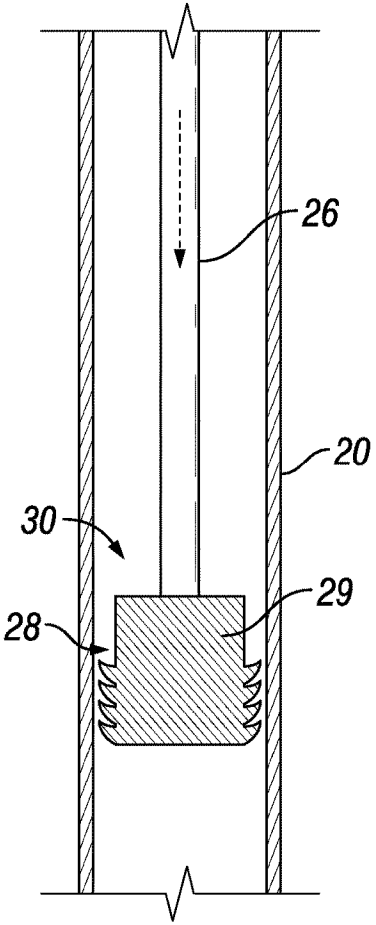
FIG. 3*a* is a section view of a valve body of a fluid removal system, shown as a plunger moving into the subterranean well in accordance with an embodiment of this disclosure.

Looking at FIGS. 3*a*-3*b*, valve body 28 can be a piston or plunger 29 that allows fluid to circulate past plunger 29 only the upward direction, using either especially designed seals or one or more one way valves. In the embodiment of FIGS. 3*a*-3*b*, plunger 29 does not have a one way valve. Plunger 29 can move in a direction into tubing 20 by either the weight of plunger 29, or in combination with a push force exerted by elongated member 26 when elongated member 26 is a rod or coiled tubing. As plunger 29 moves in a direction into tubing 20, a gap between the external surface of plunger 29 and the inner diameter surface of tubing 20 allows fluids to bypass plunger 29 (FIG. 3*a*). Plunger 29 moves in a direction out of tubing 20 with a pulling force exerted by elongated member 26. As plunger 29 moves in a direction out of tubing 20 the external surface of plunger 29 sealingly engages the inner diameter surface of tubing 20, lifting fluids out of subterranean well 12 (FIG. 3*b*).

Because tubing 20 is free of inner diameter restrictive devices along the travel length 21 of tubing 20 that have an inner diameter opening that is smaller than the outer diameter of valve body 28, valve body 28, as shown in FIGS. 2*a*-2*b* and 3*a*-3*b*, can be reciprocated over a stroke that extends the entire travel length 21 from the upper position proximate surface 14 at the top end of tubing 20 to the lower position in order to draw fluid out of subterranean well 12, providing an efficient pumping system. Valve body can be reciprocated along travel length 21 as many times as needed until tubing 20 and the near wellbore region is free of heavy drilling, completion, or other fluids and subterranean well 12 can produce itself to surface.

Figure 4:
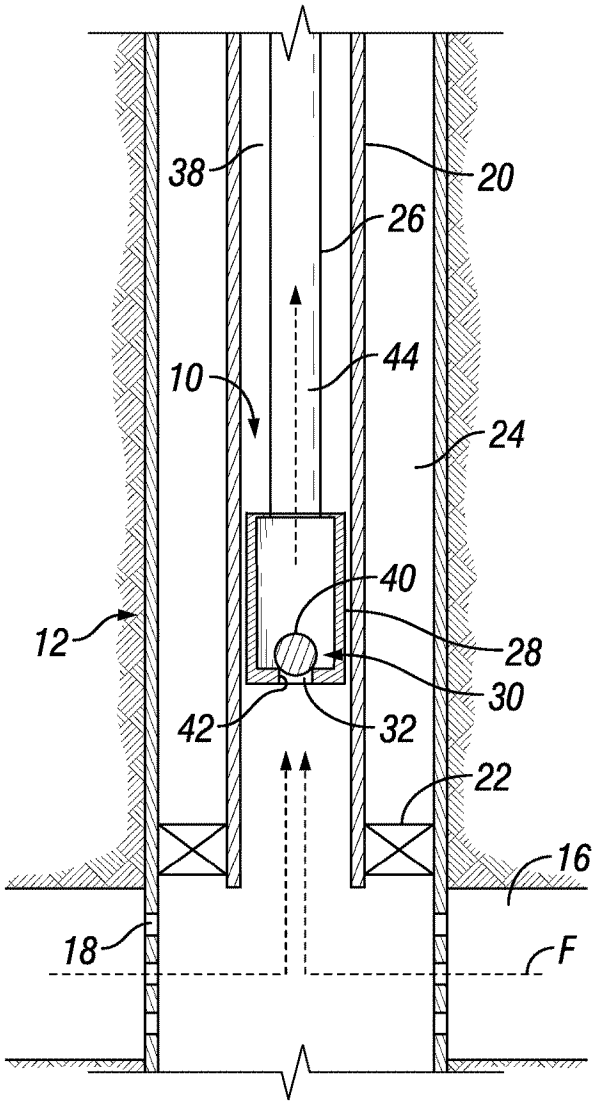
FIG. 4 is a section view of a fluid removal system in accordance with an embodiment of this disclosure.

Looking at FIG. 4, in an alternate embodiment, valve body 28 is a generally cylindrical member fixed to an end of elongated member 26. In the embodiment of FIG. 4, elongated member 26 can be a hollow member such as coiled tubing. The interior of valve body 28 is in fluid communication with bore 44 of elongated member 26.

In the embodiment of FIG. 4, valve body 28 allows fluid to circulate only into the interior of valve body 28 and enter elongated member 26 in the upward direction. One way valve 30 is shown as a ball check type valve with ball 40 and seat 42. In alternate embodiments, one way valve 30 can a check valve or other types of one way valves known in the art. When valve body 28 moves in a direction into subterranean well 12, one way valve 30 is in an open position and fluid passes through valve opening 32 of one way valve 30 and into valve body 28. Fluid can then pass into bore 44 of elongated member 26.

When moving valve body 28 in a direction out of subterranean well 12, one way valve 30 moves to a closed position and fluid cannot pass through valve opening 32. Therefore, when moving valve body 28 in a direction out of subterranean well 12, fluid within elongated member 26 and valve body 28 moves in a direction out of subterranean well 12 and can be produced to the surface. Because tubing 20 is free of inner diameter restrictive devices along the travel length 21 of tubing 20 that have an inner diameter opening that is smaller than the outer diameter of valve body 28, valve body 28 can be reciprocated over a stroke that extends the entire travel length 21 from the upper position proximate surface 14 at the top end of tubing 20 to the lower position in order to draw fluid out of subterranean well 12, providing an efficient pumping system. Valve body can be reciprocated along travel length 21 as many times as needed until tubing 20 and the near wellbore region is free of heavy drilling, completion, or other fluids and subterranean well 12 can produce itself to surface.

Looking at FIG. 5, in an alternate embodiment, valve body 28 is a generally cylindrical member fixed to an end of elongated member 26. In the embodiment of FIG. 5, elongated member 26 can be a hollow member such as coiled tubing. The interior of valve body 28 is in fluid communication with bore 44 of elongated member 26. In the embodiment of FIG. 5, valve body can have one way valve 30, circulating valve 34, or both one way valve 30 and circulating valve 34.

Swab cups 46 can circumscribe valve body 28 to form an annular seal between the outer diameter of valve body 28 and the inner diameter surface of tubing 20 as elongated member 26 moves into the subterranean well 12 and as elongated member 26 moves out of subterranean well 12. Standing valve 48 is located within tubing 20 axially below travel length 21 of tubing 20. Standing valve 48 prevents fluid from exiting the bottom end of tubing 20 when lowering elongated member 26 into tubing 20 of subterranean well 12. Standing valve 48 therefore prevents fluid from being pushed into hydrocarbon reservoir 16 when lowering elongated member 26 into tubing 20 of subterranean well 12.

As elongated member 26 moves in a direction into tubing 20, swab cups 46 displace the fluid in tubing 20 and force the fluids up elongated member 26 in a direction out of subterranean well 12 to be produced at the surface. A lighter weight fluid can be pumped down tubing 20 behind swab cups 46 to assist elongated member 26 in moving in a direction into subterranean well 12. When elongated member 26 extends within tubing 20 the travel length 21 of tubing 20, elongated member 26 can change directions and move in a direction out of subterranean well 12.

In embodiments of FIG. 5 with one way valve 30, one way valve 30 is shown as a ball check type valve with ball 40 and seat 42. In alternate embodiments, one way valve 30 can be other types of one way valves known in the art. When valve body 28 moves in a direction into subterranean well 12, one way valve 30 is in an open position and fluid passes through valve opening 32 of one way valve 30 and into valve body 28. Fluid can then pass into bore 44 of elongated member 26. When moving valve body 28 in a direction out of subterranean well 12, one way valve 30 moves to a closed position and fluid cannot pass through valve opening 32. Therefore, when moving valve body 28 in a direction out of subterranean well 12, fluid within elongated member 26 and valve body 28 moves in a direction out of subterranean well 12 and can be produced to the surface.

In embodiments of FIG. 5 with circulating valve 34. Circulating valve 34 can be in a closed position while lowering elongated member 26 into tubing 20 and circulating valve 34 can be in an open position while moving elongated member 26 in a direction out of subterranean well 12. In the closed position, circulating valve 34 prevents fluid in inner annulus 38 between an outer diameter of elongated member 26 and the inner diameter of tubing 20 from communicating with fluid within bore 44 of elongated member 26. While lowering elongated member 26 into tubing 20, fluid below swab cups 46 will enter bore 44 and be produced to the surface. Upward movement of elongated member 26 will open circulating valve 34 allowing fluid within bore 44 to communicate with inner annulus 38 to provide easy retrieval of elongated member 26.

Because tubing 20 is free of inner diameter restrictive devices along the travel length 21 of tubing 20 that have an inner diameter opening that is smaller than the outer diameter of elongated member 26, valve body 28 can be reciprocated over a stroke that extends the entire travel length 21 from the upper position proximate surface 14 at the top end of tubing 20 to the lower position in order to draw fluid out of subterranean well 12, providing an efficient pumping system. Valve body can be reciprocated along travel length 21 as many times as needed until tubing 20 and the near wellbore region is free of heavy drilling, completion, or other fluids and subterranean well 12 can produce itself to surface.

Figure 7:
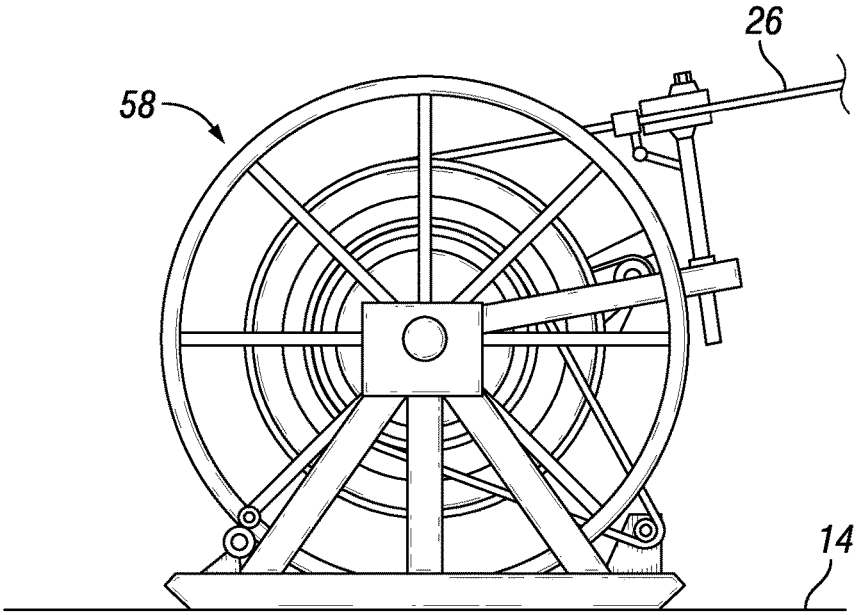
FIG. 7 is a side view of a coiled tubing reel used in connection with the fluid removal system of FIG. 6, in accordance with an embodiment of this disclosure.
Figure 8:
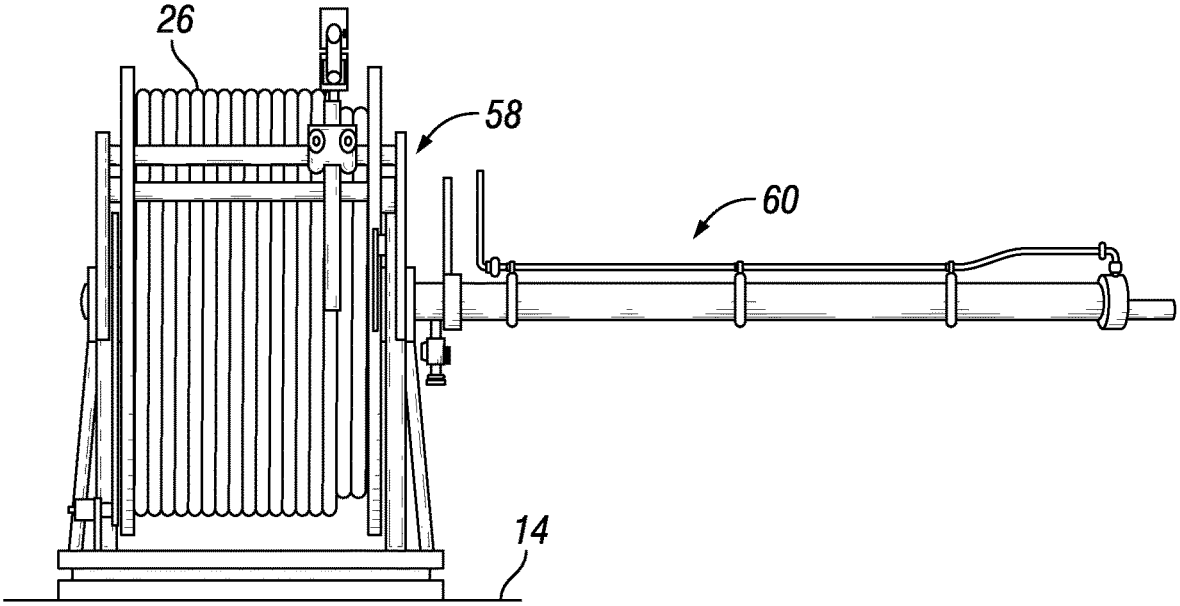
FIG. 8 is a front view of a coiled tubing reel with a hydraulic piston pump used in connection with the fluid removal system of FIG. 6, in accordance with an embodiment of this disclosure.

Looking at FIGS. 6-8, elongated member 26 can be a hollow member such as coiled tubing. Rod 50 extends within elongated member 26. Rod 50 can be comprised of individual rods, continuous coiled rods, or wire with sufficient stiffness and strength to reciprocate valve body 28. Rod 50 can be centralized with centralizers 62 within elongated member 26 to prevent rod 50 from engaging the inner diameter surface of elongated member 26, reducing wear and tear on both rod 50 and elongated member 26.

Valve body 28 is a generally cylindrical member fixed to an end of rod 50 and located at an end of elongated member 26. Valve body 28 has an interior that is in fluid communication with bore 44 of elongated member 26. In the embodiment of FIG. 6, valve body 28 is the pump plunger and the end of elongated member 26 defines pump barrel 52. Valve body 28 is located within barrel 52. An outer diameter of valve body 28 sealingly engages an inner diameter of barrel 52.

In the embodiment of FIG. 6, valve body 28 has two one way valves 30, a lower one way valve 54 and an upper one way valve 56. Moving rod 50 in the direction out of subterranean well 12 closes lower one way valve 54 and opens upper one way valve 56 and fluid within valve body 28 moves out of valve body 28 and into elongated member 26. Moving rod 50 in a direction into subterranean well 12 opens lower one way valve 54 and closes upper one way valve 56 and fluid within subterranean well 12 moves into valve body 28. Alternately, moving rod 50 in the direction out of subterranean well 12 can close both lower one way valve 54 and upper one way valve 56 for moving fluid within valve body 28 in a direction out of subterranean well 12 and moving rod 50 in a direction into subterranean well 12 opens both lower one way valve 54 and upper one way valve 56 so that fluid within subterranean well 12 moves into valve body 28. In this manner, rod 50 can be reciprocated within elongated member 26 to pump fluids within subterranean well 12 to the surface.

Looking at FIG. 6, one way valves 30 are shown as a ball check type valve with a ball and seat. In alternate embodiments, one way valve 30 can be other types of one way valves known in the art, such a flapper valves.

Because tubing 20 is free of inner diameter restrictive devices along the travel length 21 of tubing 20 that have an inner diameter opening that is smaller than the outer diameter of elongated member 26, elongated member 26 can be lowered into tubing 20 along the entire travel length 21 from the upper position proximate surface 14 at the top end of tubing 20 to the lower position and can be removed again efficiently, without have to set and retrieve additional components.

Looking at FIGS. 7-8, elongated member 26, which is shown as coiled tubing, is coiled around coiled tubing reel 58. Because fluid removal system 10 is a temporary system, the outer end of elongated member 26 can remain coiled around coiled tubing reel 58 for the duration of the operation of fluid removal system 10. Rod 50 can be reciprocated between a direction out of subterranean well 12 and a direction into 12 subterranean with hydraulic linear pump 60 located at surface 14 and attached to an end of coiled tubing reel 58.

Looking at FIGS. 1-8, in an example of operation, in order to remove fluids from a subterranean well during kickoff operation with embodiments of fluid removal system 10, elongated member 26 can be lowered into tubing 20 of subterranean well 12 over travel length 21 of tubing 20 to a lower position. Fluid can pass through valve opening 32 and into the valve body 28 as valve body 28 moves in a direction into subterranean well 12. Valve body 28 can then move in a direction out of subterranean well 12, the reciprocating action moving the fluid in a direction out of subterranean well 12. Because tubing 20 is free of tubing inner diameter restrictive devices along travel length 21 that have an inner diameter opening that is smaller than the outer diameter of elongated member 26 and valve body 28, valve body 28 moves freely between an upper position proximate to a top end of tubing 20 and the lower position. In certain embodiments, elongated member 26 can be reciprocated along the entire travel length 21.

Where the elongated member 26 is coiled tubing or rolled rod, lowering elongated member 26 into tubing 20 can be accomplished by unrolling elongated member 26 from a reel and, moving valve body 28 in a direction out of subterranean well 12 can include rerolling elongated member 26 back onto the reel. Because fluid removal system 10 can be used as a temporary system, a portion of elongated member 26 can remain coiled around the reel during the fluid removal operation.

Therefore, systems and methods to initiate well production when existing reservoir pressure is insufficient to lift fluids to the surface and external lift energy is required is disclosed herein. Certain embodiments of the systems and methods of this disclosure will provide for the production tubing being used as pump barrel or the whole length of coiled tubing being used as the barrel so that the length of the stroke is only limited to the length of the production tubing. The reciprocating action of certain embodiments is achieved using the coiled tubing unit power and reel. Systems and methods described herein can be used for temporary applications or for long term applications, if required.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for removing a drilling and completion fluids from a subterranean well, the method including:

lowering an elongated member into a tubing of the subterranean well a travel length of the tubing to a lower position, the elongated member having a valve body located at, and fixed to, an end of the elongated member, wherein the fluid passes through a valve opening of a one way valve and into the valve body as the elongated member moves in a direction into the subterranean well;

moving the elongated member in a direction out of the subterranean well so that the one way valve moves to a closed position and the fluid cannot pass through the valve opening, moving the fluid in the direction out of the subterranean well, wherein the elongated member is moved in the direction out of the subterranean well the entire travel length; and moving the elongated member in a direction into the subterranean well and in a direction out of the subterranean well until the wellbore is free of the drilling and completion fluids then removing the elongated member from the subterranean well so that the fluids of the subterranean well produce to the surface without the elongated member.

2. The method of claim 1, wherein the elongated member is a rod.

3. The method of claim 1, wherein an outer diameter of the valve body sealing engages an inner diameter of the tubing when moving the elongated member in the direction out of the subterranean well.

4. The method of claim 3, wherein the valve body is in fluid communication with an annulus between an outer diameter of the elongated member and the inner diameter of the tubing so that moving the elongated member in the direction out of the subterranean well moves the fluid in the annulus in the direction out of the subterranean well.

5. The method of claim 1, wherein the elongated member is coiled tubing and where:

the elongated member is unrolled from a reel when lowering the elongated member into the tubing of the subterranean well;

moving the valve body in the direction out of the subterranean well includes rerolling the elongated member onto the reel;

a portion of the elongated member remains coiled around the reel when the elongated member is at the lower position; and the elongated member is unrolled from the reel and rerolled onto the reel with a hydraulic linear pump located at an earth's surface.

6. The method of claim 1, wherein a standing valve is located within the tubing axially below the travel length of the tubing, and wherein the standing valve prevents the fluid from exiting the bottom end of the tubing when lowering the elongated member into the tubing of the subterranean well.

7. The method of claim 6, wherein an outer diameter of the valve body sealingly engages an inner diameter of the tubing when lowering the elongated member into the tubing of the subterranean well and when moving the elongated member in the direction out of the subterranean well.

8. A method for removing a drilling and completion fluids from a subterranean well, the method including:

setting a standing valve within a tubing axially below a travel length of the tubing;

lowering a hollow elongated member into the tubing of the subterranean well the travel length of the tubing to a lower position proximate to a bottom end of the tubing, wherein the standing valve prevents the fluid from exiting the bottom end of the tubing when lowering the elongated member into the tubing of the subterranean well, and wherein an outer diameter of a valve body sealingly engages an inner diameter of the tubing while lowering the hollow elongated member into the tubing, moving the fluid in a direction out of the subterranean well through the elongated member;

moving the elongated member in a direction out of the subterranean well, wherein the outer diameter of the valve body sealingly engages the inner diameter of the tubing while moving the elongated member in the direction out of the subterranean well, where the elongated member is moved in the direction out of the subterranean well the entire travel length; and moving the elongated member in a direction into the subterranean well and in a direction out of the subterranean well until the wellbore is free of the drilling and completion fluids then removing the elongated member from the subterranean well so that the fluids of the subterranean well produce to the surface without the elongated member.

9. The method of claim 8, wherein a circulating valve of the elongated member is in a closed position while lowering the hollow elongated member into the tubing and the circulating valve is in an open position while moving the elongated member in the direction out of the subterranean well.

10. The method of claim 8, wherein the fluid passes through a valve opening of a one way valve and into the valve body as the elongated member moves in a direction into the subterranean well, and the one way valve moves to a closed position and the fluid cannot pass through the valve opening while moving the elongated member in the direction out of the subterranean well.

11. A method for removing a drilling and completion fluids from a subterranean well, the method including:

lowering a hollow elongated member into a tubing of the subterranean well a travel length of the tubing to a lower position, the elongated member having a barrel at an end of the elongated member, wherein a rod extends within the elongated member and the rod has a valve body located at an end of the rod and within the barrel;

reciprocating the rod between a direction out of the subterranean well and a direction into the subterranean well so that:

moving the rod in the direction out of the subterranean well closes a lower one way valve and opens an upper one way valve and the fluid within the valve body moves out of the valve body and into the elongated member; and moving the rod in the direction into the subterranean well opens the lower one way valve and closes the upper one way valve and the fluid within the subterranean well moves into the valve body; and moving the rod in a direction into the subterranean well and in a direction out of the subterranean well until the wellbore is free of the drilling and completion fluids then removing the rod from the subterranean well so that the fluids of the subterranean well produce to the surface without the rod; wherein the tubing is free of tubing inner diameter restrictive devices along the travel length that would restrict movement of the elongated member so that the elongated member moves freely between an upper position proximate to a top end of the tubing and the lower position.

12. The method of claim 11, wherein the elongated member is coiled tubing and a hydraulic linear pump at a surface located at an end of a coil tubing reel reciprocates the rod between the direction out of the subterranean well and the direction into the subterranean well.

13. The method of claim 11, wherein the rod is selected from a group consisting of individual rods, continuous coiled rods, or wire.

14. The method of claim 11, further including centralizing the rod within the elongated member to prevent the rod from engaging an inner diameter surface of the elongated member.

15. A fluid removal system for a subterranean well for removing a drilling and completion fluids from the subterranean well, the fluid removal system having:

an elongated member sized to extend into a tubing of the subterranean well a travel length of the tubing to a lower position a distance proximate to a bottom end of the tubing;

a valve body located at an end of the elongated member;

a one way valve moveable between an open position where a fluid can pass through a valve opening and into the valve body as the valve body moves into the subterranean well and a closed position where the fluid cannot pass through the valve opening as the valve body moves out of the subterranean well; wherein the tubing is free of tubing inner diameter restrictive devices along the travel length so that the elongated member is freely moveable between an upper position proximate to a top end of the tubing and the lower position; and the elongated member is removable from the subterranean well so that the fluids of the subterranean well produce to the surface without the elongated member after the wellbore is free of the drilling and completion fluids.

16. The fluid removal system of claim 15, wherein a portion of the elongated member remains coiled around a reel during a fluid removal operation and the elongated member is unrolled from the reel and rerolled onto the reel with a hydraulic linear pump located at an earth's surface.

17. The fluid removal system of claim 15, wherein the elongated member is a coiled tubing.

18. The fluid removal system of claim 15, wherein the elongated member is selected from a group consisting of a rod, a wireline, and a slickline.

19. The fluid removal system of claim 15, wherein the valve body sealingly engages an inner diameter surface of the tubing as the elongated member moves out of the subterranean well.

20. The fluid removal system of claim 15, wherein the valve body sealingly engages an inner diameter surface of the tubing as the elongated member moves into the subterranean well and as the elongated member moves out of the subterranean well.

21. The fluid removal system of claim 15, wherein the valve body is fixed to the end of the elongated member.

22. The fluid removal system of claim 15, further including a rod extending within the elongated member and wherein the valve body is fixed to an end of the rod.

* * * * *